US009206717B2

(12) United States Patent
Krüger et al.

(10) Patent No.: US 9,206,717 B2
(45) Date of Patent: Dec. 8, 2015

(54) ACTIVE SOUND ABSORBERS

(71) Applicants: Jan Krüger, Neuhausen (DE); Manfred Nicolai, Esslingen (DE); Michael Pommerer, Uhingen (DE); Georg Wirth, Kirchheim/Teck (DE)

(72) Inventors: Jan Krüger, Neuhausen (DE); Manfred Nicolai, Esslingen (DE); Michael Pommerer, Uhingen (DE); Georg Wirth, Kirchheim/Teck (DE)

(73) Assignee: Eberspaecher Exhaust Technology GmbH & Co. KG, Neunkirchen (DE)

( * ) Notice: Subject to any disclaimer, the term of this patent is extended or adjusted under 35 U.S.C. 154(b) by 201 days.

(21) Appl. No.: 13/649,597

(22) Filed: Oct. 11, 2012

(65) Prior Publication Data

US 2013/0092471 A1 Apr. 18, 2013

(30) Foreign Application Priority Data

Oct. 14, 2011 (DE) ..... 10 2011 084 567

(51) Int. Cl.

| | |
|---|---|
| ***F01N 1/10*** | (2006.01) |
| ***F01N 1/24*** | (2006.01) |
| ***F01N 1/06*** | (2006.01) |
| ***G10K 11/16*** | (2006.01) |
| ***F01N 13/18*** | (2010.01) |

(52) U.S. Cl.

CPC *F01N 1/065* (2013.01); *F01N 1/06* (2013.01); *F01N 1/10* (2013.01); *F01N 1/24* (2013.01); *F01N 13/1888* (2013.01); *G10K 11/16* (2013.01); *G10K 2210/112* (2013.01); *G10K 2210/1282* (2013.01)

(58) Field of Classification Search

CPC ..... F01N 1/10; F01N 1/24; F01N 1/06

USPC ..... 181/252, 206; 381/71.4, 71.5

See application file for complete search history.

(56) References Cited

U.S. PATENT DOCUMENTS

| | | | | | |
|---|---|---|---|---|---|
| 4,177,874 | A | * | 12/1979 | Angelini et al. | 181/206 |
| 5,229,556 | A | * | 7/1993 | Geddes | 181/206 |
| 5,233,137 | A | * | 8/1993 | Geddes | 181/206 |
| 5,267,321 | A | * | 11/1993 | Langberg | 381/72 |
| 5,319,165 | A | * | 6/1994 | Geddes | 181/206 |
| 5,336,856 | A | * | 8/1994 | Krider et al. | 181/206 |
| 5,446,249 | A | * | 8/1995 | Goodman et al. | 181/206 |

(Continued)

FOREIGN PATENT DOCUMENTS

| | | | |
|---|---|---|---|
| DE | 102008018085 | A1 | 10/2009 |
| DE | 102009049280 | A1 | 4/2011 |

(Continued)

*Primary Examiner* — David Warren
*Assistant Examiner* — Christina Schreiber
(74) *Attorney, Agent, or Firm* — Reinhart Boerner Van Deuren P.C.

(57) ABSTRACT

The present invention relates to an active sound absorber (3) for an exhaust system (1) of an internal combustion engine, preferably of a motor vehicle, comprising a housing (7), a connecting pipe (8) for the acoustic and fluidic connecting of the housing (7) with the exhaust system (1), an active membrane (10) which in the housing (7) separates a front volume (12), fluidically connected with the connecting pipe (8), from a back volume (13), and an actuator (11) for vibration stimulation of the active membrane (10).

A risk of damage by condensate in the back volume (13) can be reduced by at least one condensation line (14), which fluidically connects the back volume (13) with the front volume (12), in which vapor contained in the exhaust gas condenses, and which directs the condensate which occurs to the front volume (12).

28 Claims, 6 Drawing Sheets

(56) References Cited

U.S. PATENT DOCUMENTS

| | | | | |
|---|---|---|---|---|
| 5,541,373 | A * | 7/1996 | Cheng | 181/206 |
| 5,619,020 | A * | 4/1997 | Jones et al. | 181/206 |
| 5,693,918 | A * | 12/1997 | Bremigan et al. | 181/206 |
| 6,088,459 | A * | 7/2000 | Hobelsberger | 381/96 |
| 6,160,892 | A * | 12/2000 | Ver | 381/71.5 |
| 6,684,977 | B2 * | 2/2004 | Stuart | 181/206 |
| 6,758,304 | B1 * | 7/2004 | McLean | 181/206 |
| 6,778,673 | B1 * | 8/2004 | Hobelsberger | 381/96 |
| 6,996,242 | B2 * | 2/2006 | McLean et al. | 381/71.5 |
| 7,006,639 | B2 * | 2/2006 | Hobelsberger | 381/96 |
| 7,891,463 | B2 * | 2/2011 | Kruger et al. | 181/206 |
| 8,485,309 | B2 * | 7/2013 | Busse et al. | 181/206 |
| 2001/0046300 | A1 * | 11/2001 | McLean | 381/71.4 |
| 2007/0205043 | A1 * | 9/2007 | Krueger et al. | 181/206 |
| 2007/0240934 | A1 * | 10/2007 | Van de Flier et al. | 181/252 |
| 2008/0053747 | A1 * | 3/2008 | Krueger et al. | 181/206 |
| 2009/0255754 | A1 * | 10/2009 | Kruger et al. | 181/206 |
| 2013/0202148 | A1 * | 8/2013 | Grupp et al. | 381/389 |
| 2015/0071452 | A1 * | 3/2015 | Fenchel et al. | 381/71.5 |

FOREIGN PATENT DOCUMENTS

| | | | |
|---|---|---|---|
| JP | 2-4149 | U | 1/2002 |
| JP | 2005282523 | A | 10/2005 |
| JP | 2006129227 | A | 5/2006 |
| JP | 6-60717 | U | 8/2006 |
| JP | 2009250244 | A | 10/2009 |
| WO | WO 92/19080 | A1 | 10/1992 |

* cited by examiner

ACTIVE SOUND ABSORBERS

CROSS-REFERENCE TO RELATED PATENT APPLICATIONS

This patent application claims priority to German Patent Application No. 102011084567.4, filed Oct. 14, 2011, the entire teachings and disclosure of which are incorporated herein by reference thereto.

FIELD OF THE INVENTION

The present invention relates to an active sound absorber for an exhaust system of an internal combustion engine, preferably of a motor vehicle with the features of the introductory clause of Claim 1.

BACKGROUND OF THE INVENTION

From DE 10 2009 049 280 A1 an active sound absorber is known, which has a housing and a connecting pipe for the acoustic and fluidic connecting of the housing with the exhaust system. A loudspeaker is arranged in the housing, which comprises an active membrane and an actuator for vibration stimulation of the membrane. In the housing, the membrane separates a front volume, connected fluidically with the connecting pipe, from a back volume.

Such active sound absorbers are used, by feeding in a calculated sound, in particular counter-sound or anti-sound, to influence an exhaust noise of the exhaust system in a desired manner, preferably to damp it. For this, the front volume is in fluidic connection with the exhaust system via the connecting pipe. The front volume typically has no direct connection to the atmosphere outside the exhaust system, i.e. to the environment of the exhaust system. The back volume is delimited by the active membrane and the housing of the sound absorber, so that the loudspeaker operates on the rear side on a closed volume and on the front side on the exhaust system.

Due to the type of construction, the membrane of such a loudspeaker with an electrodynamic actuator is sensitive with respect to different static or respectively quasi-static pressures in front and behind the membrane. Depending on the area of the membrane and the rigidity of a membrane suspension, the membrane of the loudspeaker is deflected from the central position by a differential pressure, which reduces the capability of the loudspeaker to generate dynamic alternating pressures in front of and behind the membrane through its electrodynamic drive (actuator). If this deflection from the central position continues furthermore over a longer period of time and additionally under thermal stress of the loudspeaker, the membrane can remain permanently deflected owing to the creep behaviour of individual components of the loudspeaker, in particular of the membrane suspension, also without a pressure difference existing furthermore between front volume and back volume and acting on the membrane.

The differential pressures occurring in this connection between front volume and back volume can be roughly differentiated from one another as follows. On the one hand, a static pressure difference occurs by an alteration of the outer air pressure in the atmosphere or respectively environment of the exhaust system as a result of the weather, e.g. on a change from a low pressure area to a high pressure area or as a result of a change to the height above sea level, e.g. when driving uphill. These static pressure changes occur relatively slowly, for example with a time constant or period duration of more than 10 sec., i.e. with a frequency of less than 0.1 Hz. Furthermore, a quasi-static pressure difference occurs by altering the flow conditions in the exhaust system, in particular by the Bernoulli effect at the junction between the connecting pipe and the exhaust system. The flow conditions in the exhaust system change as a function of the respective operating state of the internal combustion engine, for example on a change from idle mode to higher loads or full load, which is involved with higher mass flows and exhaust gas temperatures. These quasi-static pressure changes occur for example with a time constant or period duration of between 0.1 sec. and 10 sec., i.e. with a frequency between 0.1 Hz and 10 Hz. Finally, dynamic pressure differences can also occur, namely the alternating pressures generated conventionally by the loudspeaker, i.e. the acoustic signals for influencing the acoustic emission of the exhaust system. These dynamic pressure fluctuations typically have a period duration or respectively time constant of less than 0.1 sec., i.e. frequencies greater than 10 Hz.

In order to ensure the proper function of the electrodynamic loudspeaker, i.e. the assembly of active membrane and associated electrodynamic actuator, therefore all differential pressures with a period duration greater than 0.1 sec., i.e. the static and quasi-static pressure fluctuations, must be equalized. At the same time, it must be ensured that in the relevant frequency range from 10 Hz the electrodynamically generated alternating pressures are not substantially reduced or even acoustically short-circuited.

A compensation or equalization of the static pressure differences, i.e. of the slow fluctuations of the atmospheric air pressure with respect to the closed back volume can be achieved in that at least one relatively small pressure equalization opening is provided, which fluidically connects the back volume with the environment of the sound absorber. Under certain circumstances here a slight permeability of the housing can already be sufficient in order to equalize the static pressure differences.

According to DE 10 2009 049 280 A1 mentioned in the introduction, an equalization of the quasi-static pressure fluctuations can be enabled by at least one pressure equalization opening, which fluidically connects the back volume with the front volume. Such a pressure equalization opening is dimensioned here so as to be comparatively small, in order to avoid an acoustic short-circuit between front volume and back volume.

Such pressure equalization openings between front volume and back volume are gas-permeable and open to diffusion, whereby in particular exhaust gas, which arrives into the front volume via the connecting pipe from the exhaust gas system, can also enter into the back volume. Here, at the same time, a temperature gradient occurs, because the exhaust gas in the exhaust system is generally exposed to higher temperatures than in the back volume. The problem arises here that humidity linked in the exhaust gas, i.e. vapour, condenses in the cooler back volume. Depending on the exhaust gas composition, the condensate occurring here is comparatively aggressive, in particular the condensate can comprise sulphuric acid. In the long run, the aggressive condensate can damage the electrodynamic actuator and connecting cable. Measures for improving the condensate resistance at the loudspeaker and the insulation of the cable and the connection between the cables and the actuator are comparatively laborious and increase the production costs. If one avoids these cost-intensive measures for improving the condensate resistance, the active sound absorber can only be positioned on the exhaust gas system in the region of a tailpipe, wherein by structural measures at the respective tailpipe, provision can be made that the quasi-static pressure difference between front volume and back volume, brought about by the flow speed, is then as small as possible. Consequently, the pressure equalization opening between front volume and back volume can be dispensed with. However, this significantly restricts the configuration of the active sound damping and impedes or respectively prevents the use of an active sound absorber at a region distant from the tailpipe upstream in the direction of the engine, although the acoustic effectiveness of the active sound absorber is possibly better there.

SUMMARY OF THE INVENTION

The present invention is concerned with the problem of indicating an improved embodiment for an active sound absorber, which is distinguished in that on the one hand disadvantages which occur through quasi-static differential pressures between front volume and back volume are reduced or eliminated or avoided, wherein at the same time disadvantages which can occur through the formation of condensate in the back volume are reduced or eliminated or avoided.

This problem is solved in the invention in particular by the subjects of the independent claims. Advantageous embodiments are the subject of the dependent claims.

According to a first solution, the invention is based on the general idea to fluidically connect the back volume with the front volume via at least one condensation line. This condensation line is designed here so that vapour contained therein in the exhaust gas condenses, wherein the condensation line then directs the condensate occurring therein to the front volume. In other words, the respective condensation line supports the condensation such that the condensate occurs inside the condensation line, i.e. whilst the vapour moves from the front volume in the direction towards the back volume. As the back volume is closed, no through-flow of the condensation line occurs, but rather only diffusion processes or respectively very slow volume displacements through the respective pressure equalization. The great dwell period of the vapour in the condensation line, which occurs on the one hand through the slow gas movements and on the other hand can be achieved through a correspondingly dimensioned length of the line, the condensation can take place substantially already inside the condensation line, so that vapour scarcely arrives into the back volume. This means that the condensate can not occur in the back space, but rather already on the way thereto, inside the condensation line. By a suitable arrangement of the condensation line, the latter can direct the condensate occurring therein easily into the front volume, where, owing to the temperatures prevailing there, it can be vaporized again and entrained by the exhaust gas stream. Through the equipping of the active sound absorber with such a condensation line, therefore the occurrence of aggressive condensate in the back volume can be significantly reduced or even avoided. Consequently, the risk of damage by aggressive condensate on the actuator is also reduced. Furthermore, it is noteworthy that through the fluidic connection, created by means of the condensation line, between the front volume and the back volume at the same time also the desired pressure equalization between front volume and back volume is able to be realized. As a whole, the proposed measure opens up the possibility of also using the active sound absorber close to the engine, so that almost any desired positionings for the active sound absorber on the exhaust gas system are able to be realized. The condensation line replaces here the pressure equalization opening between front volume and back volume known from the prior art, cf. the aforesaid DE 10 2009 049 280 A1.

According to an advantageous embodiment, the condensation line can therefore fluidically connect the back volume for pressure equalization without acoustic short-circuit with the front volume. In other words, the condensation line is dimensioned so that it is unsuitable for a transmission of dynamic pressure fluctuations between front volume and back volume, in particular owing to the friction occurring in the condensation line. Expediently for this the condensation line is distinctly longer than its internal diameter. In particular, the line length is at least 10 times greater than the line diameter, preferably the line length is at least 100 times greater than the line diameter. The condensation line can basically be configured so as to be straight-lined. Likewise, an embodiment is conceivable in which the condensation line is curved, e.g. spiral-shaped and/or helical, in order to realize a great line length with a short installation length.

In another advantageous embodiment, the condensation line can be arranged entirely in the interior of the housing, so that an internal condensation line is concerned. This type of construction reduces the risk of leakages.

According to an expedient further development, a substantial section of the condensation line running inside the housing can now be arranged in the back volume. Expediently, more than half, i.e. more than 50% of the length of the condensation line is arranged in the back volume. In particular, at least 75% of the length of the condensation line is arranged in the back volume. Hereby, the temperature prevailing in the back volume acts on a comparatively large proportion of the condensation line, so that a substantial section of the condensation line is cool compared with the exhaust gas, and brings about the desired condensation.

According to another advantageous embodiment, the condensation line can have a section running outside the housing. This section can expediently connect an end section of the condensation line, connected with the front volume, with an end section of the condensation line connected with the back volume. In this way, a condensation line is created running at least partially externally, which opens up possibilities for supporting the formation of condensate inside the condensation line.

For example, according to a further development, the section of the condensation line arranged outside the housing can be cooled. For example, a purely passive cooling is conceivable by the temperatures prevailing in the environment of the sound absorber. A further passive cooling can be brought about by a flowing around of the sound absorber and of the section of the condensation line which runs externally, for example by airflow of a motor vehicle equipped with the internal combustion engine. An active cooling of the section of the condensation line running outside the housing is likewise conceivable, for example with the aid of a fan which generates an air current for acting upon the section. The section can be equipped here with cooling ribs or suchlike. It is likewise possible to integrate the said section into a heat exchanger, which in addition is integrated into a cooling circuit, so that by means of the heat exchanger, heat can be transferred from the condensation line to a coolant of the cooling circuit.

According to another advantageous embodiment, the condensation line can be a pipe which is produced in particular from a metallic material and is distinguished by a particularly high degree of thermal conductivity.

According to a preferred embodiment, the back volume can be sealed hermetically with respect to an environment of the sound absorber. This means that the housing of the sound absorber does not have an opening in the region of the back volume through which a fluid can arrive into the back volume or can emerge therefrom. In other words, the back volume is entirely enclosed, apart from the fluidic connection with the front volume created by means of the condensation line. In particular in this case, neither a pressure equalization opening is present, which fluidically connects the back volume with the environment, nor is another connection provided, via which a fluid can be fed to the back volume or removed therefrom.

According to a second solution, the present invention is based on the general idea of providing at least one pressure equalization chamber. Such a pressure equalization chamber surrounds an equalization volume here, which is fluidically connected with the front volume via at least one connecting line. Therefore, the pressure of the front volume prevails in the equalization volume. Furthermore, at least one passive membrane is provided, which is positioned so that it is exposed on the one hand to the pressure prevailing in the equalization volume, and on the other hand to the pressure prevailing in the back volume. In other words, the passive membrane deforms as a function of the pressure difference acting thereon, which through the fluidic coupling between equalization volume and front volume ultimately corresponds to the pressure difference between front volume and back volume. Therefore, the passive membrane can transfer the pressure prevailing in the front volume to the back volume depending on its rigidity, whereby the desired pressure equalization is more or less realized. It is noteworthy here that through the connection of the passive membrane, a gas exchange between front volume and back volume is no longer possible. In other words, in the second solution which is presented here, the front volume and the back volume are separated from one another fluidically. Consequently, no condensate can occur in the back volume. As a whole, the proposed measure opens up the possibility of also using the active sound absorber close to the engine, so that almost any desired positionings are able to be realized for the active sound absorber on the exhaust system. In so far as condensate occurs in the equalization volume, this can be directed through the connecting line to the front volume.

In order to increase the efficiency of the pressure equalization chamber, the passive membrane is designed to be more flexible than the active membrane of the loudspeaker. In particular, the passive membrane is at least twice as elastic as the active membrane.

In a particularly advantageous embodiment, the pressure equalization chamber can have a chamber housing arranged in the back volume, wherein then the passive membrane forms at least a part of the chamber housing. In other words, the passive membrane inside the housing of the sound absorber separates the equalization volume from the back volume. Hereby, leakage problems can be reduced.

According to an advantageous further development, the passive membrane can form the entire chamber housing. In other words, the passive membrane is shaped so that it forms the chamber housing and surrounds the equalization volume. In particular, the housing can be configured as an elastic balloon or as an elastic bellows. In this case, the passive membrane defines the elastic skin of the balloon or respectively the elastic bellows body. In so far as the passive membrane forms the entire chamber housing, the chamber housing can expand or respectively contract as a function of the pressure difference between the equalization volume and the back volume, in order to adjust the pressures between equalization volume and back volume to one another. A complete pressure equalization is not possible here owing to the inner tension of the passive membrane. The softer the passive membrane is here, the closer the pressures between equalization volume and back volume can adapt themselves.

In an alternative embodiment, the pressure equalization chamber can have a chamber housing arranged outside the back volume or respectively outside the housing, wherein then the passive membrane in the chamber housing separates the equalization volume from a coupling volume. A coupling line then provides for a fluidic connection between the coupling volume and the back volume. Therefore, the pressure of the back volume prevails in the coupling volume. A pressure difference between front volume and back volume therefore leads to a corresponding pressure difference between the equalization volume and the coupling volume, which can be more or less equalized by a corresponding deformation of the passive membrane. It applies here also that the desired pressure equalization is all the more successful, the softer the passive membrane is.

According to a further alternative embodiment, the pressure equalization chamber can be constructed in the housing, wherein then the passive membrane in the housing separates the equalization volume from the back volume. This internal structural form also reduces leakage problems.

In an expedient further development, the connecting line can be arranged in the housing and can extend through the back volume. Additionally or alternatively, provision can be made that owing to a correspondingly selected positioning of the passive membrane inside the housing, the equalization volume is situated distally to the front volume, so that in particular the back volume is arranged between the equalization volume and the front volume. Furthermore, the equalization volume is expediently arranged inside the housing, so that the passive membrane has no contact with the front volume.

In another embodiment, the connecting line can be arranged so that it directs condensate, possibly occurring in the equalization volume, to the front volume. In other words, the connecting line is coordinated with the provided installation situation so that it has an incline in the direction of the front volume.

A third solution of the invention is based on the general idea of compensating the static deflection of the active membrane, formed owing to a pressure difference between the front volume and the back volume, by a corresponding activation of the actuator. For this, the active sound absorber is equipped with a sensor system for measuring a pressure difference between the front volume and the back volume. This sensor system can comprise, for example, a differential pressure sensor, which directly measures the pressure difference between the front volume and the back volume. Likewise, the use of two absolute pressure sensors is conceivable, one of which measures the absolute pressure in the front volume, whilst the other measures the absolute pressure in the back volume. The difference of the two absolute pressures then produces the desired differential pressure. The sensor system is additionally coupled with a control, which serves to activate the actuator. This control is now programmed or respectively configured so that it activates the actuator as a function of the measured pressure difference so that it deflects the active membrane contrary to the deflection caused by the pressure difference, whereby the deflection of the active membrane caused by the pressure difference can be more or less compensated. As a control for actuating the actuator is present in any case in the active loudspeaker, the solution which is presented here only requires a sensor system suitable for differential pressure measurement and a corresponding coupling in connection with a suitable programming. Therefore, this embodiment can be realized at a comparatively favourable cost and almost without structural effort. In particular, such an embodiment manages without pressure equalization between the front volume and the back volume. In particular, this structural form can therefore be characterized in that the front volume and the back volume are separated fluidically from one another. By the fluidic separation of the back volume from the front volume, the risk of a formation of condensate in the back volume also does not exist. As a whole, the proposed measure opens up the possibility of also using the active sound absorber close to the engine, so that almost any desired positionings for the active sound absorber on the exhaust gas system are able to be realized.

According to an advantageous embodiment, the control can superimpose a static control signal dependent on the measured pressure difference on dynamic control signals, with which the control activates the actuator for driving the active membrane, so that this generates counter-sound for influencing, in particular for damping airborne sound which is entrained in the exhaust gas. In other words, the static control signal generated for compensating the deflection of the active membrane caused by the pressure difference is modulated to the dynamic control signals, by which the control activates the actuator, so that the latter activates the active membrane, so that the latter can introduce the desired pressure pulsations into the exhaust system.

A fourth solution of the invention is likewise based on the general idea of compensating the static deflection of the active membrane, formed owing to a pressure difference between the front volume and the back volume, by a corresponding activation of the actuator. Deviating from the third solution described above, in the fourth solution the pressure difference is not measured, but rather the deflection, resulting therefrom, of the active membrane from its central position is determined, in order to use the deflection directly as a basis for the activation of the actuator. For this, the sound absorber comprises a device for determining a deflection of the active membrane from its central position. A control provided for activating the actuator is coupled with the said device and activates the actuator as a function of the determined membrane deflection for compensating the membrane deflection. In this way, a laborious pressure measurement can be dispensed with.

The determining of the membrane deflection can be carried out in a different manner. For example, the device can have a sensor system for measuring the membrane deflection. Alternatively, the device can evaluate the current consumption of the actuator on its activation and determine the membrane deflection as a function thereof. This purely electronic measure manages without an additional sensor system. In particular here the usual current consumption of the actuator occurring during the sound damping operation can be evaluated. This measure is based on the consideration that current consumption of the actuator alters as a function of a deflection of the membrane, because the actuator operates where applicable with or against a prestressing of the membrane. Alternatively, it is also conceivable that the device evaluates a microphone signal of a microphone detecting the sound emitted from the active membrane and determines the membrane deflection as a function thereof. This measure is based on the consideration that the sound emitted from the active membrane alters as a function of the prestressing of the membrane. Such a microphone is present in any case in a conventional active sound damping system, so that also in this solution an additional sensor system can be dispensed with. It is clear that basically also other measures are conceivable, in order to determine the actual membrane deflection.

According to a fifth solution, the present invention is based on the general idea of equalizing the pressure difference between the front volume and the back volume with the aid of a conveying device, which is fluidically connected to the back volume for this purpose. If the pressure in the back volume is higher than the pressure in the front volume, gas or respectively air can be drawn off from the back volume by the conveying device and conveyed for example into the environment or into the front volume, in order to bring about the pressure equalization. If, on the other hand, the pressure in the back volume is lower than in the front volume, gas or respectively air can be drawn in for example from the environment or from the front volume by means of the conveying device and can be fed to the back volume, in order to bring about the pressure equalization. A signal correlated with the pressure difference or a signal correlated with the deflection of the membrane from its central position can serve here as output signal for activating the conveying device. The corresponding devices have already been described above.

According to a particularly advantageous embodiment, which is able to be used in particular for all the solutions and embodiments mentioned above, at least one pressure equalization opening can be provided, which fluidically connects the back volume with an environment of the housing of the sound absorber. By means of such a pressure equalization opening, which can be configured so as to be gas-permeable and fluid-tight by suitable measures, for example by means of a membrane which is gas-permeable and is impermeable to fluid, the static pressure differences described in the introduction between the back volume and the atmospheric environment can be equalized. The first solution described above, in which the front volume and the back volume are fluidically connected with one another by the condensate line, can be configured as in the associated embodiments so that the back volume is fluidically separated from the environment of the housing of the sound absorber. In these cases, therefore, such a pressure equalization opening between the back volume and the environment can be dispensed with. On the other hand, in the other solutions described above, including the associated embodiments, it appears to be expedient to provide such a pressure equalization opening.

Further important features and advantages of the invention will emerge from the subclaims, from the drawings and from the associated description of the figures with the aid of the drawings.

It shall be understood that the features mentioned above and to be further explained below are able to be used not only in the respectively indicated combination but also in other combinations or in isolation, without departing from the scope of the present invention.

BRIEF DESCRIPTION OF THE DRAWINGS

Preferred example embodiments of the invention are illustrated in the drawings and are explained in further detail in the following description, wherein identical reference numbers refer to identical or similar or functionally identical components.

There are shown, respectively diagrammatically.

DETAILED DESCRIPTION OF THE INVENTION

Figure 1:
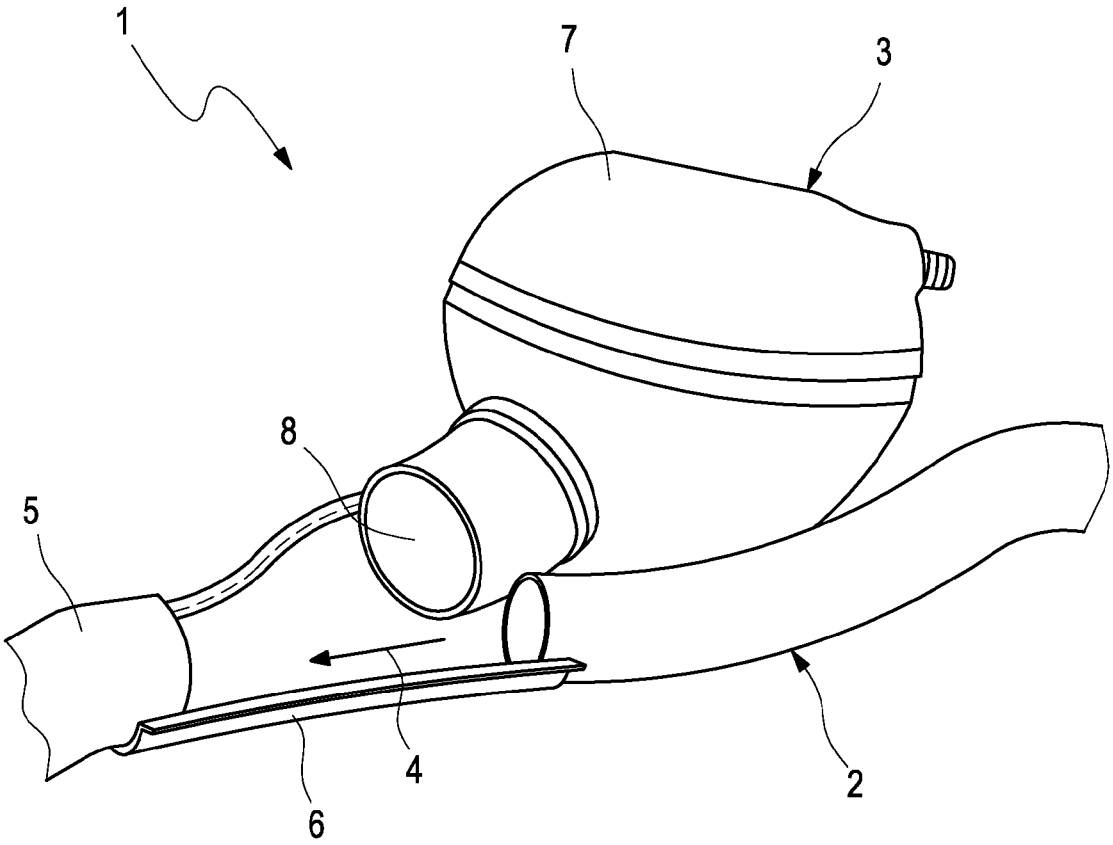
FIG. 1 an isometric view, partially in section, of an exhaust system in the region of an active sound absorber, FIGS. 2 to 10 highly simplified schematic diagrams of the active sound absorber in various embodiments.

In accordance with FIG. 1, an exhaust system 1 of an internal combustion engine, which is not shown here, comprises an exhaust tract 2 and at least one active sound absorber 3, which is connected to the exhaust tract 2 and hence to the exhaust system 1. In the example, the sound absorber 3 is connected to an exhaust pipe 5 directing an exhaust gas stream indicated by an arrow in FIG. 1, in the operation of the internal combustion engine, wherein for this in the example a Y-shaped connecting piece 6 is used, only half of which is illustrated in FIG. 1. It is clear that the sound absorber 3 can basically be connected to any desired component of the exhaust system 1, i.e. not necessarily to an exhaust pipe 5. The active sound absorber 3 serves here for the damping of airborne sound which is entrained in the exhaust gas stream 4 or respectively propagates in the exhaust tract 2.

The sound absorber 3 comprises a housing 7 and a connecting pipe 8 for fluidically connecting the housing 7 with the exhaust system 1. Through this connecting pipe 8 the acoustic coupling takes place between the sound absorber 3 and the remaining exhaust system 1. The connecting pipe 8 is not flowed through here by the exhaust gas. However, the exhaust gas can enter into the connecting pipe 8.

According to FIGS. 2 to 10, the active sound absorber 3 comprises a loudspeaker 9, which comprises an active membrane 10 and an actuator 11. The active membrane 10 in the housing 7 separates a front volume 12, fluidically connected with the connecting pipe 8, from a back volume 13, which in the illustrations of FIGS. 2 to 8 is situated on a side of the loudspeaker 9 facing away from the connecting pipe 8. Accordingly, the front volume 12 faces the connecting pipe 8, whereas the back volume 13 faces away from the connecting pipe 8. The actuator 11 operates electromagnetically and serves for vibration stimulation of the active membrane 10.

Figure 2:
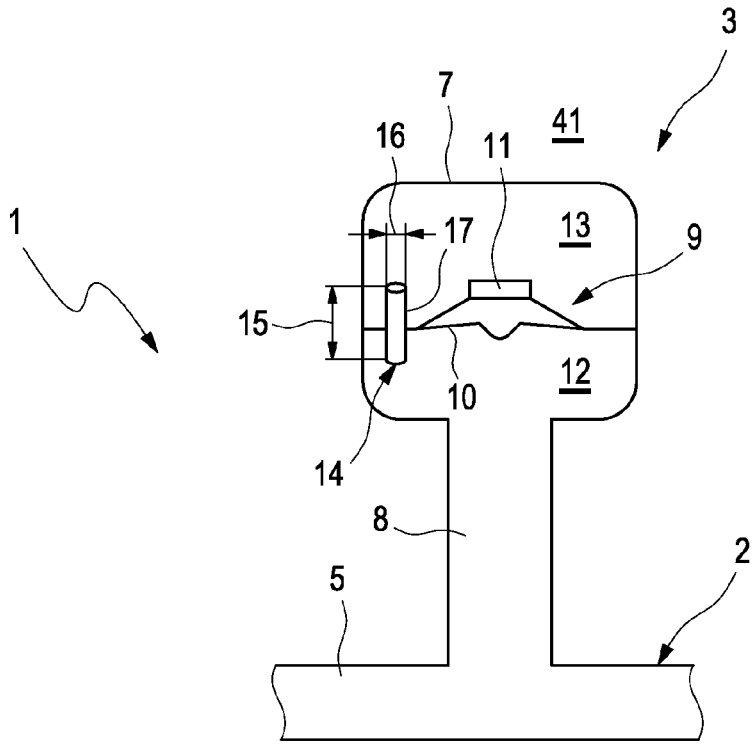
Figure 3:
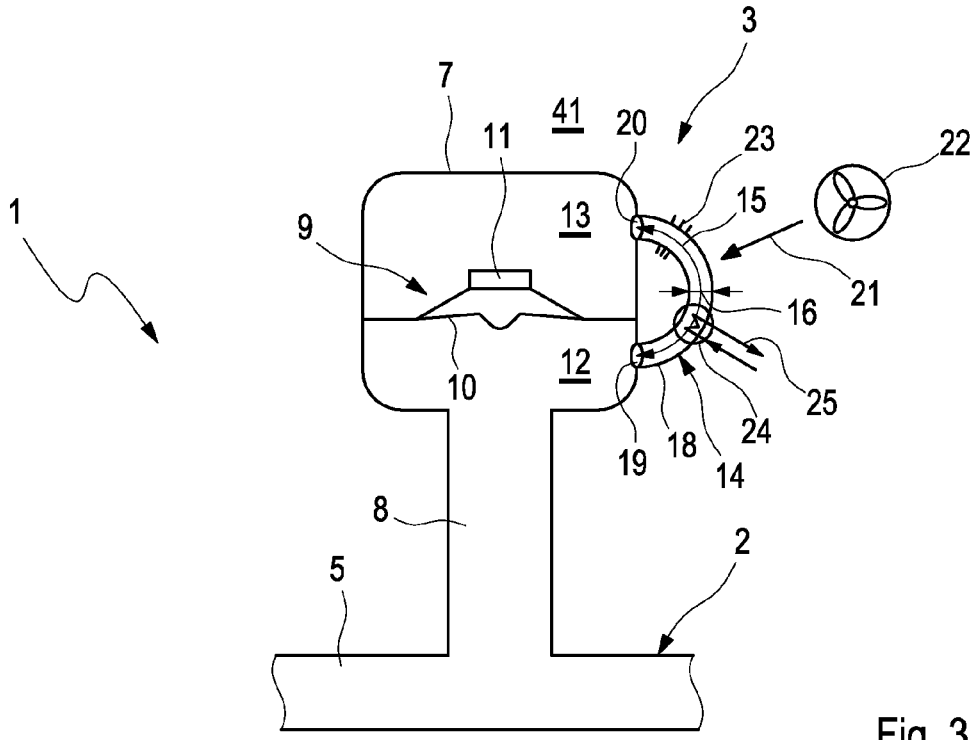

In the embodiments shown in FIGS. 2 and 3, the sound absorber 3 is equipped in addition with at least one condensation line 14, which is preferably formed from a metallic tubular body. Basically, the condensation line 14 can also be designed as an elastic hose, in particular made of plastic. The condensation line 14 leads to a fluidic connection of the back volume 13 with the front volume 12, whereby a pressure equalization is brought about between the front volume 12 and the back volume 13. So that this pressure equalization only takes place for static or quasi-static pressure differences and not for dynamic pressure differences, the condensation line 14 is designed so that it fluidically connects the back volume 13 with the front volume 12 without an acoustic short-circuit. This is achieved for example by a corresponding throttling effect, in particular by friction within the condensation line 14. For example, a length 15 of the condensation line 14 is distinctly greater than a diameter 16 of the condensation line 14. Suitable ratios are, for example, at least 10:1 or at least 100:1.

The condensation line 14 is, in addition, designed so that vapour which is contained in the exhaust gas, which in particular penetrates by diffusion processes into the condensation line 14, condenses in the condensation line 14. In addition, the condensation line 14 is arranged so that the condensate occurring therein can flow to the front volume 12. Accordingly, the condensation line 14, in the installed state of the sound absorber 3, has an incline in the direction of the front volume 12.

So that the condensation effect in the condensation line 14 occurs to the desired extent, according to the embodiment shown in FIG. 2, the condensation line 14 can be arranged entirely inside the housing 7. Expediently here a substantial section 17, which extends over at least 50% of the entire condensation line length 15, is arranged in the back volume 13. Hereby, a majority of the condensation line 14, namely the substantial section 17, is exposed to the temperatures prevailing in the back volume 13, which are distinctly lower than the temperatures of the exhaust gas entering into the condensation line 14. Hereby, the desired condensation by vapour can be realized in the condensation line 14.

In the embodiment shown in FIG. 3, the condensation line 14 is arranged so that it has a section 18 running outside the housing 7. This section 18 lying on the exterior connects a first end section 19 of the condensation line 14, connected with the front volume 12, with a second end section 20 of the condensation line 14, which is connected with the back volume 13. The section 18, lying on the exterior, can be cooled for example by means of a cooling gas stream 21, which is indicated by an arrow in FIG. 3. This may be an airflow here, which occurs in the operation of a vehicle, which is equipped with the internal combustion engine, the exhaust gases of which are conveyed away by means of the exhaust system 1 which is presented here. Alternatively, the cooling gas stream 21 can also be realized for example by means of a fan 22. To improve the heat transmission between the section 18 lying on the exterior and the cooling gas stream 21, the condensation line 14 can have cooling ribs 23 in the section 18 lying on the exterior. Additionally or alternatively, the condensation line 14 in the section 18 lying on the exterior can be integrated into a heat exchanger 24, which in turn is integrated into a cooling circuit 25, wherein a media separation is provided between the cooling medium in the cooling circuit 25 and the exhaust gas in the condensation line 14.

According to FIGS. 4 to 7, the sound absorber 3 can be equipped with at least one pressure equalization chamber 26, which surrounds an equalization volume 27. Furthermore, at least one connecting line 28 is present, which fluidically connects the equalization volume 27 with the front volume 12. In addition, at least one passive membrane 29 is provided, which on the one hand is exposed to the pressure prevailing in the equalization volume 27 and on the other hand is exposed to the pressure prevailing in the back volume 13. Accordingly, the passive membrane 29 deforms as a function of the pressure difference between the equalization volume 27 and the back volume 13. As the equalization volume 27 is connected in a communicating manner with the front volume 12 by the connecting line 28, the pressure prevailing in the equalization volume 27 corresponds to the pressure prevailing in the front volume 12. Therefore, the passive membrane 29 deforms as a function of the pressure difference between the back volume 13 and the front volume 12. In FIGS. 4 to 7, an initial state is illustrated for the passive membrane 29 by a continuous line, whilst at the same time a state is illustrated by a broken line, in which the passive membrane 29 is deformed owing to the pressure difference between the front volume 12 and the back volume 13.

Figure 4:
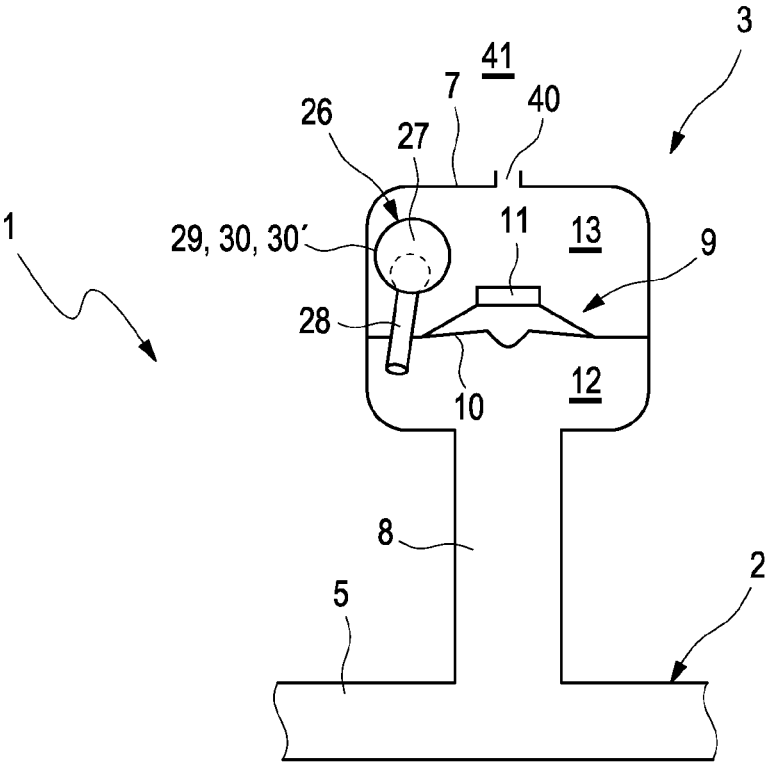
Figure 5:
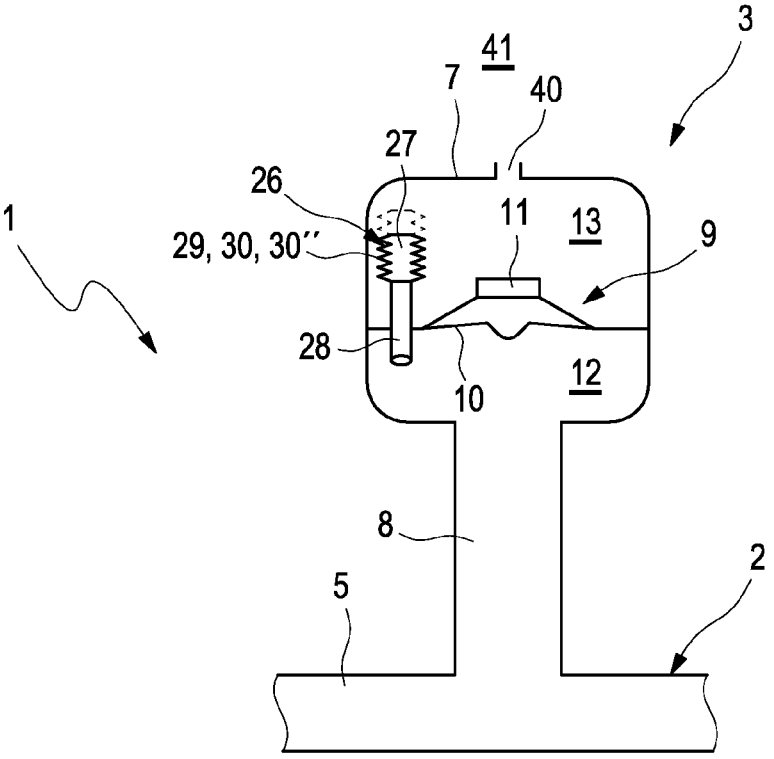

In the embodiments of FIGS. 4 and 5, the pressure equalization chamber 26 comprises a chamber housing 30, which is arranged in the back volume 13 in the interior of the housing 7. The passive membrane 29 forms here at least a portion of the chamber housing 30. Consequently, the passive membrane 29 in the interior of the housing 7 separates the equalization volume 27 from the back volume 13, so that it is indirectly exposed to the pressure of the back volume 13. In the examples which are shown, the entire chamber housing 30 is formed here by the passive membrane 29. In the embodiment shown in FIG. 4, the chamber housing 30 is configured as an elastic balloon 30'. This balloon 30' or respectively its skin or covering is formed by the passive membrane 29. In the embodiment shown in FIG. 5, the chamber housing 30 is configured as a bellows 30". The bellows body is formed here by the elastic passive membrane 29.

Figure 6:
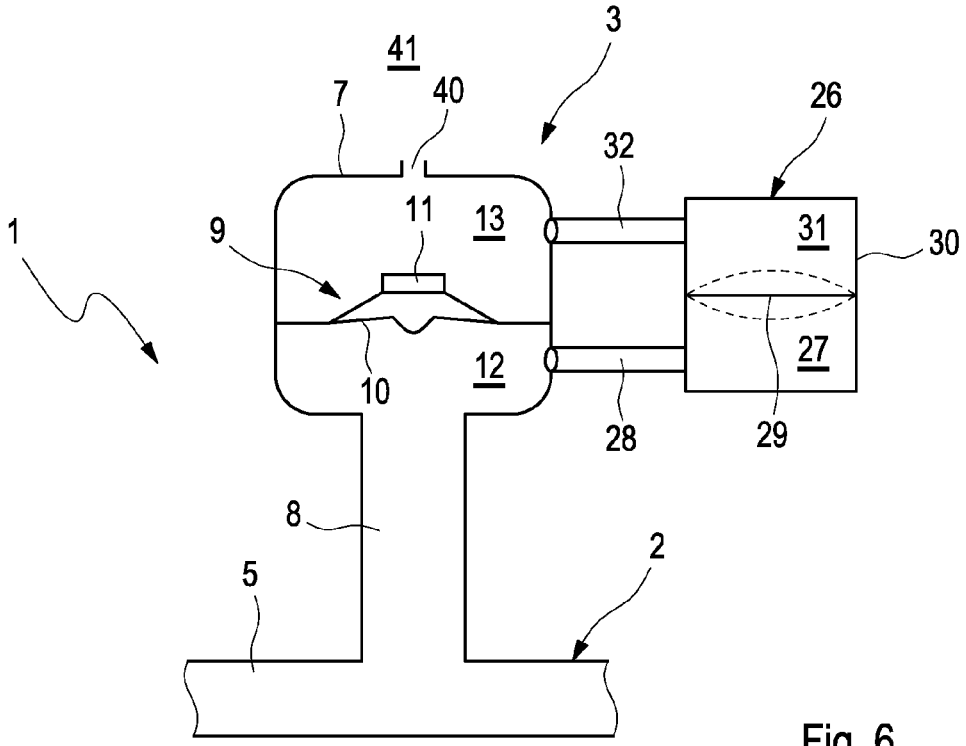

In the embodiment shown in FIG. 6, the pressure equalization chamber 26 is arranged outside the housing 7. In addition, the chamber housing 30 is arranged outside the housing 7. In this embodiment, the passive membrane 29 in the chamber housing 30 separates the equalization volume 27 from a coupling volume 31. A coupling line 32 provides for a fluidic connection of the coupling volume 31 with the back volume 13. In the example of FIG. 6, the chamber housing 30 is arranged spaced apart from the housing 7 of the sound absorber 3 by the connecting line 28 and the coupling line 32. It is likewise conceivable to mount the chamber housing 30 directly onto the housing 7, wherein then the coupling line 32 and the connecting line 28 reduce to a connecting opening or respectively a coupling opening. The respective opening then penetrates either a wall of the housing 7 and a wall of the chamber housing 30 or a shared wall of the housing 7 and of the chamber housing 30. The connecting opening then provides for the fluidic coupling between the equalization volume 27 and the front volume 12. The coupling opening then provides for the fluidic coupling between the coupling volume 31 and the back volume 13.

Figure 7:
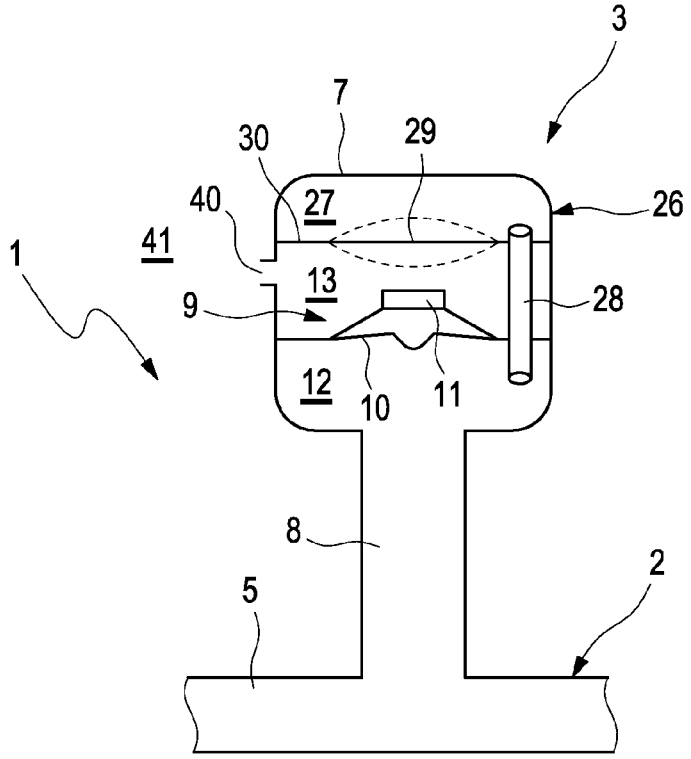

In the embodiment shown in FIG. 7, the pressure equalization chamber 26 is again constructed in the interior of the housing 7, wherein then the passive membrane 29 in the housing 7 separates the equalization volume 27 from the back volume 13. In the example of FIG. 7, the structural effort for the chamber housing 30 is reduced to a dividing wall, which in FIG. 7 is also designated by 30, which inside the housing 7 separates a region containing the back volume 13 from a region containing the equalization volume 27. The passive membrane 29 is mounted or respectively suspended on this dividing wall 30. The connecting line 28 is also arranged inside the housing 7, wherein it extends through the back volume 13 in order to be able to connect the equalization volume 27 with the front volume 12.

In the embodiments shown in FIGS. 4 to 7, the connecting line 28 is respectively arranged so that it directs condensate, which can occur in the connecting line 28 or respectively in the equalization volume 27, to the front volume 12. For this, the respective connecting line 28 in the installed state can have a corresponding incline in the direction of the front volume 12.

Figure 8:
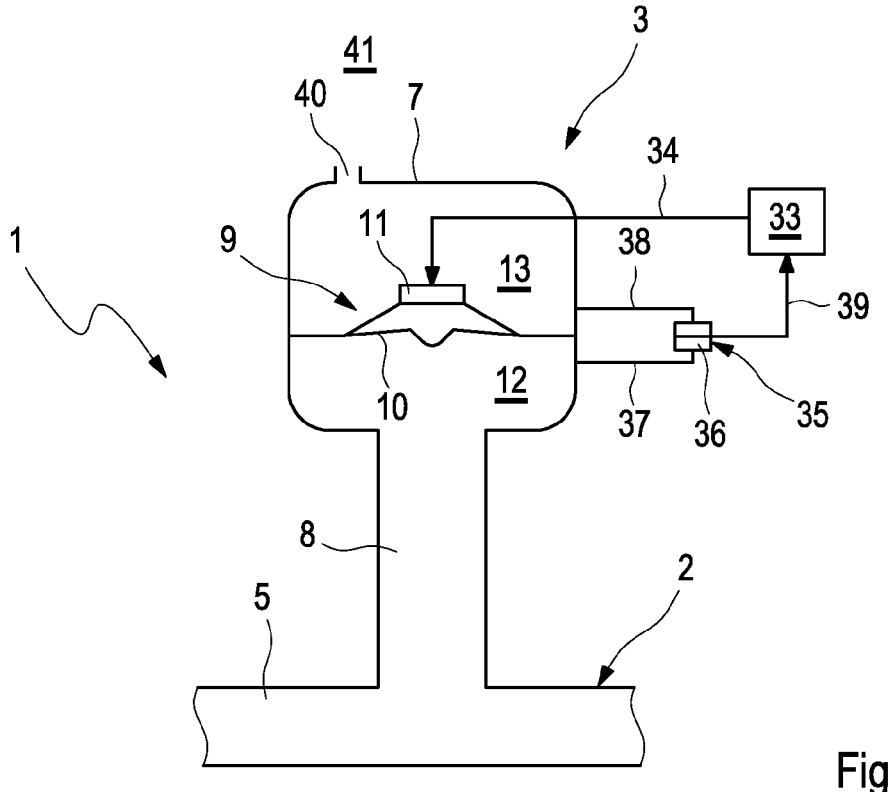

In accordance with FIG. 8, the sound absorber 3 can basically be equipped in all embodiments with a control 33, which can activate the actuator 11 via a corresponding control line 34. The actuator 11 then drives the active membrane 10, as a function of its activation, to generate pressure waves, in particular sound waves.

Moreover, the embodiment of the sound absorber 3 shown in FIG. 8 can have a sensor system 35, by means of which a pressure difference between the front volume 12 and the back volume 13 can be measured. In the example of FIG. 8, the sensor system 35 comprises a differential pressure sensor 36, which on the one hand is coupled with the front volume 12 in a suitable manner, e.g. via a first sensor line 37, and which on the other hand is coupled with the back volume 13 in a suitable manner, e.g. via a second sensor line 38. The sensor system 35 is coupled with the control 33 via a signal line 39, so that the control 33 knows the pressure difference between the front volume 12 and the back volume 13. The control 33 is now configured or respectively programmed so that it activates the actuator 11 as a function of the measured pressure difference. Through the targeted activation of the actuator 11, a deflection of the active membrane 10 brought about by the pressure difference prevailing between the front volume 12 and the back volume 13 can be more or less compensated. For example, an excess pressure in the front volume 12 brings about a deflection of the active membrane 10 in the direction of the back volume 13. By corresponding activation of the actuator 11, the latter can drive the active membrane 10 statically in the direction of the front volume 12 and in particular move it back again into the initial position. Therefore, the deflection of the active membrane 10, brought about by the pressure difference between the front volume 12 and the back volume 13, is substantially neutralized or respectively compensated.

The control 33 is configured here expediently so that it generates a static control signal dependent on the measured pressure difference, in order to produce the desired static movement of the active membrane 10 for the compensation of the deflection of the active membrane 10 caused by the pressure difference. In contrast to this, the control 33 generates dynamic control signals for the production of pressure oscillations, which are to be transmitted into the exhaust tract 2 via the connecting pipe 8, by which control signals the control 33 activates the actuator 11 for driving the active membrane 10. Depending on this activation, the active membrane 10 can now generate the desired pressure oscillations. In particular, this concerns here counter-sound for combating airborne sound entrained in the exhaust gas. The static control signals, which are provided for the compensation of the deflection of the active membrane 10 caused by the pressure difference, are now superimposed on the dynamic control signals, which are provided for producing the pressure oscillations or respectively the counter-sound.

Figure 9:
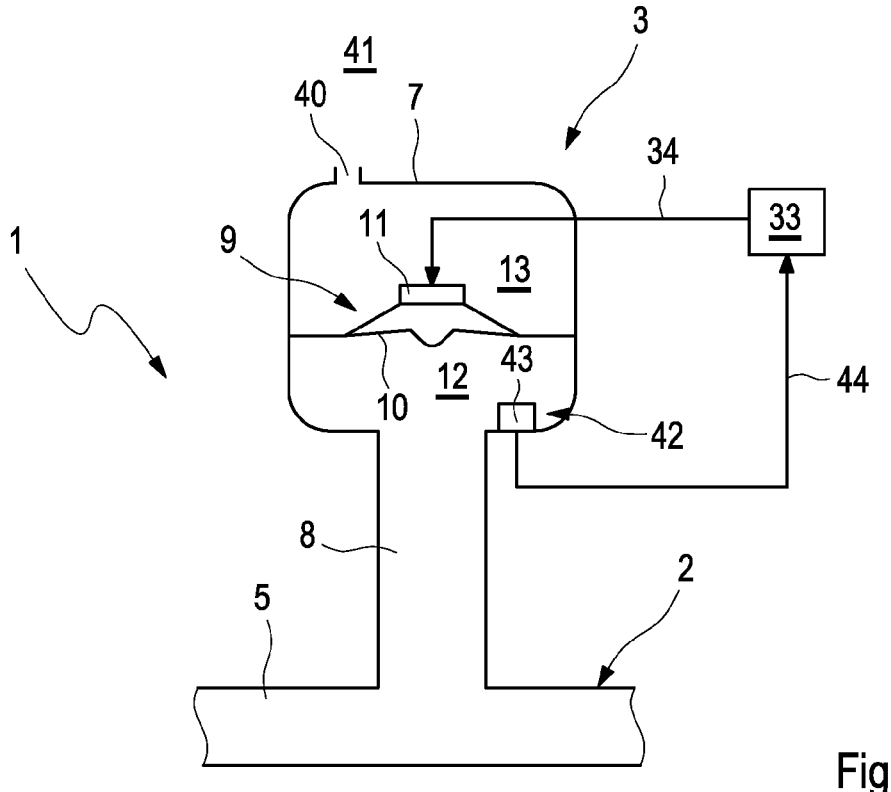

FIG. 9 shows an embodiment in which, instead of a pressure difference which results in a deflection of the active membrane 10 from its central position, the membrane deflection is determined directly and is used as an input parameter for the static control signal for compensation. Thus, in accordance with FIG. 9, a device 42 can be provided, by means of which the membrane deflection can be determined. The deflection of the active membrane 10 from its central position is determined, which it then assumes when the pressures in the front volume 12 and in the back volume 13 are of equal extent. In the example of FIG. 9, the device 42 comprises a microphone 43, which can detect and measure the airborne sound emitted from the active membrane 10. The microphone signals are supplied via a corresponding signal line 44 to the control 33, in order to evaluate them. As the sound emission of the membrane 10 varies from its prestressing or respectively from its deflection, the membrane deflection can be determined by a target-performance comparison. Alternatively, the device 42 in accordance with FIG. 10 can have a sensor system 45, by means of which the deflection of the membrane 10 can be measured. A corresponding signal can then be supplied again to the control 33 via a signal line 46.

Figure 10:
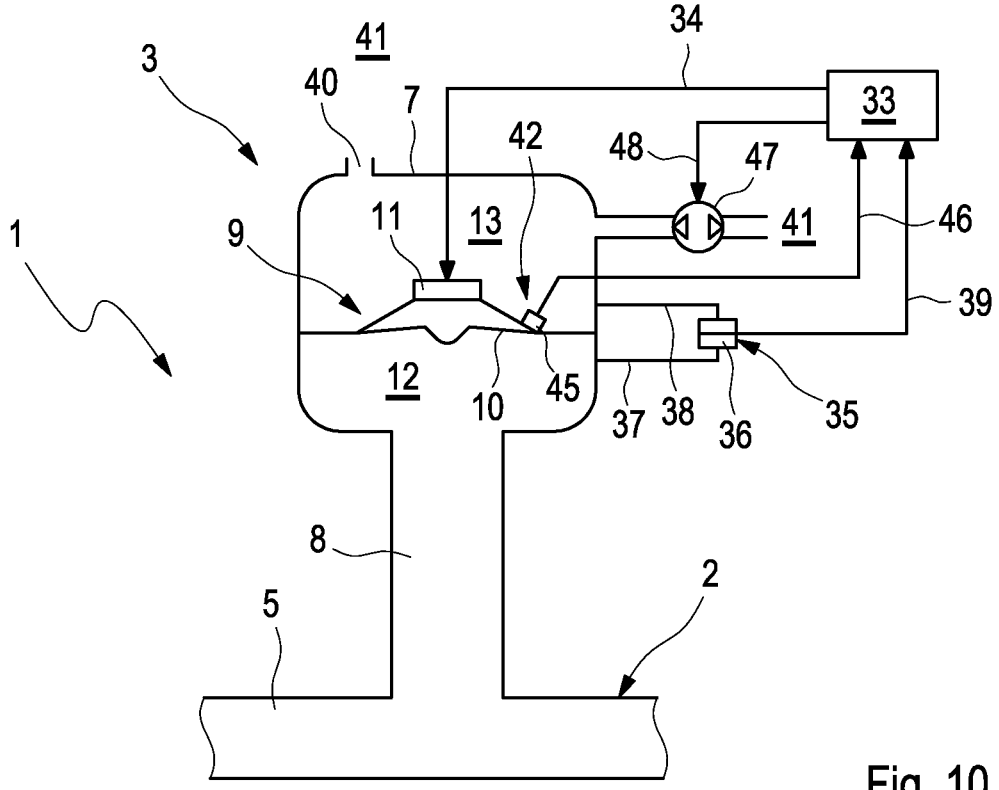

FIG. 10 now shows an embodiment in which a conveying device 47 is provided, which is fluidically connected to the back volume 13. A control line 48 connects the control 33 with the conveying device 47. The conveying device 47, e.g. a pump, can serve as an excess pressure generator or respectively underpressure generator, in order to be able to act upon the back volume 13 with excess pressure or respectively with underpressure according to requirements, such that the undesired static membrane deflection is entirely or partially compensated. The membrane deflection can serve here directly as base signal for the actuation of the conveying device 47, which membrane deflection can be determined again by means of the device 42. Alternatively, the pressure difference between the front volume 12 and the back volume 13 can be used for the activation of the conveying device 47, because the pressure difference correlates with the membrane deflection. The sensor system 35 can be used again for determining the pressure difference. In the example, the conveying device 47 is arranged externally on the housing 7. It is clear that the conveying device can also be arranged in the interior of the housing 7. In addition, in the example the conveying device 47 conveys into the environment 41 or respectively draws in from the environment 41, in order to adjust in the back volume 13 the pressure to the pressure prevailing in the front volume 12.

In the embodiments shown in FIGS. 4 to 10, the sound absorber 3 is equipped in addition with at least one pressure equalization opening 40, which is formed in the housing 7 or respectively in a wall of the housing 7 and which fluidically connects the back volume 13 with an environment 41 of the sound absorber 3. The pressure equalization opening 40 can be designed here entirely so that it is permeable for gas but impermeable for fluid. For example, for this, the pressure equalization opening 40 can be closed by a gas-permeable membrane, which is not illustrated here, however. In the embodiments shown in FIGS. 2 and 3, basically such a pressure equalization opening 40 can likewise be present. However, an embodiment is preferred, in which such a pressure equalization opening 40 is dispensed with. In particular, therefore, in the embodiments of FIGS. 2 and 3, the back volume 13 is uncoupled from the environment 41.

Although it is not thus illustrated here, it is clear that features which are only shown in one embodiment are also able to be realized in the other embodiments, in so far as this is expedient.

The invention claimed is:

1. An active sound absorber for an exhaust system of an internal combustion engine, preferably of a motor vehicle, comprising:

a housing;

a connecting pipe acoustically and fluidically connecting the housing with the exhaust system;

an active membrane, which in the housing separates a front volume, fluidically connected with the connecting pipe, from a back volume;

an actuator configured for vibration stimulation of the active membrane, wherein at least one condensation line, which fluidically connects the back volume with the front volume, in which vapour contained in the exhaust gas condenses and which directs to the front volume the condensate which occurs; and wherein the condensation line fluidically connects the back volume with the front volume and is configured for pressure equalization without acoustic short-circuit.

2. The sound absorber according to claim 1, wherein the condensation line is arranged in the interior of the housing.

3. The sound absorber according to claim 2, wherein a substantial section of the condensation line is arranged in the back volume.

4. An active sound absorber for an exhaust system of an internal combustion engine, preferably of a motor vehicle, comprising:

a housing;

connecting pipe for the acoustic and fluidic connecting of the housing with the exhaust system;

an active membrane, which in the housing separates a front volume, fluidically connected with the connecting pipe, from a back volume;

an actuator for vibration stimulation of the active membrane, wherein at least one condensation line, which fluidically connects the back volume with the front volume, in which vapour contained in the exhaust gas condenses and which directs to the front volume the condensate which occurs; and wherein the condensation line has a section running outside the housing, which connects an end section of the condensation line, connected with the front volume, with an end section of the condensation line, connected with the back volume.

5. The sound absorber according to claim 4, wherein the section of the condensation line, arranged outside the housing, is cooled actively or passively.

6. The sound absorber according to claim 1, wherein the condensation line (14) is a pipe.

7. The sound absorber according to claim 1, wherein in an installed state of the sound absorber, the condensation line has an incline in the direction of the front volume.

8. The sound absorber according to claim 1, wherein the back volume is hermetically sealed with respect to an environment of the sound absorber.

9. The sound absorber according to claim 1, further comprising at least one pressure equalization opening, which fluidically connects the back volume with an environment of the housing of the sound absorber.

10. An active sound absorber for an exhaust system of an internal combustion engine, preferably of a motor vehicle, comprising at least one pressure equalization chamber, which surrounds an equalization volume, wherein at least one connecting line fluidically connects the equalization volume with a front volume, wherein at least one passive membrane is provided, which on the one hand is exposed to the pressure prevailing in the equalization volume and on the other hand is exposed to the pressure prevailing in a back volume.

11. The sound absorber according to claim 10, wherein:

the pressure equalization chamber has a chamber housing arranged in the back volume; and the passive membrane forms at least a portion of the chamber housing.

12. An active sound absorber for an exhaust system of an internal combustion engine, preferably of a motor vehicle, comprising at least one pressure equalization chamber, which surrounds an equalization volume, wherein at least one connecting line fluidically connects the equalization volume with a front volume, wherein at least one passive membrane is provided, which on the one hand is exposed to the pressure prevailing in the equalization volume and on the other hand is exposed to the pressure prevailing in a back volume;

wherein the pressure equalization chamber has a chamber housing arranged in the back volume, and wherein the passive membrane forms at least a portion of the chamber housing; and wherein the passive membrane forms the entire chamber housing.

13. An active sound absorber for an exhaust system of an internal combustion engine, preferably of a motor vehicle, comprising at least one pressure equalization chamber, which surrounds an equalization volume, wherein at least one connecting line fluidically connects the equalization volume with a front volume, wherein at least one passive membrane is provided, which on the one hand is exposed to the pressure prevailing in the equalization volume and on the other hand is exposed to the pressure prevailing in a back volume;

wherein the pressure equalization chamber has a chamber housing arranged in the back volume, and wherein the passive membrane forms at least a portion of the chamber housing; and wherein the chamber housing is configured as an elastic balloon or as an elastic bellows.

14. An active sound absorber for an exhaust system of an internal combustion engine, preferably of a motor vehicle, comprising at least one pressure equalization chamber, which surrounds an equalization volume, wherein at least one connecting line fluidically connects the equalization volume with a front volume, wherein at least one passive membrane is provided, which on the one hand is exposed to the pressure prevailing in the equalization volume and on the other hand is exposed to the pressure prevailing in a back volume;

wherein:

the pressure equalization chamber has a chamber housing arranged outside the back volume and/or outside a housing of the sound absorber;

in the chamber housing the passive membrane separates the equalization volume from a coupling volume; and a coupling line fluidically connects the coupling volume with the back volume.

15. The sound absorber according to claim 10, wherein:

the pressure equalization chamber is constructed in a housing of the sound absorber; and in the housing the passive membrane separates the equalization volume from the back volume.

16. The sound absorber according to claim 15, wherein the connecting line is arranged in the housing and extends through the back volume.

17. The sound absorber according to claim 10, wherein the connecting line is arranged so that it directs condensate occurring in the equalization volume to the front volume.

18. The sound absorber according to claim 10, further comprising at least one pressure equalization opening, which fluidically connects the back volume with an environment of a housing of the sound absorber.

19. An active sound absorber for an exhaust system of an internal combustion engine, preferably of a motor vehicle, comprising a sensor arrangement for measuring a pressure difference between a front volume and a back volume, wherein a control, provided for activating an actuator, is coupled with the sensor arrangement and activates the actuator as a function of the measured pressure difference for compensating a deflection of an active membrane caused by the pressure difference.

20. The sound absorber according to claim 19, wherein the control superimposes a static control signal, dependent on the measured pressure difference, on dynamic control signals, by which the control activates the actuator for driving the active membrane, so that the latter generates counter-sound for the damping of airborne sound entrained in the exhaust gas.

21. The sound absorber according to claim 19, further comprising at least one pressure equalization opening, which fluidically connects the back volume with an environment of a housing of the sound absorber.

22. An active sound absorber for an exhaust system of an internal combustion engine, preferably of a motor vehicle, comprising a device for determining a deflection of an active membrane from its central position, wherein a control, provided for activating an actuator, is coupled with the device and activates the actuator as a function of the determined membrane deflection for compensating the membrane deflection.

23. The sound absorber according to claim 22, wherein the device has a sensor system for measuring the membrane deflection.

24. The sound absorber according to claim 22, wherein the device evaluates the current consumption of the actuator on its activation and determines the membrane deflection as a function thereof.

25. The sound absorber according to claim 22, wherein the device evaluates a microphone signal of a microphone detecting the sound emitted from the active membrane and determines the membrane deflection as a function thereof.

26. The sound absorber according to claim 22, further comprising at least one pressure equalization opening, which fluidically connects a back volume with an environment of a housing of the sound absorber.

27. An active sound absorber for an exhaust system of an internal combustion engine, preferably of a motor vehicle, comprising, a conveying device fluidically connected with a back volume, wherein a control, coupled with the conveying device, activates the conveying device as a function of a pressure difference between a front volume and the back volume, or as a function of a deflection of an active membrane from its central position for reducing the pressure difference and the membrane deflection for drawing in from the back volume or for conveying into the back volume.

28. The sound absorber according to claim 27, further comprising at least one pressure equalization opening, which fluidically connects the back volume with an environment of a housing of the sound absorber.

* * * * *